United States Patent [19]

Durand et al.

[11] 4,453,277

[45] Jun. 12, 1984

[54] PROTECTIVE HELMET

[75] Inventors: Philip E. Durand, Hudson; Lawrence R. McManus, Lynn, both of Mass.

[73] Assignee: The United States of America as represented by the Secretary of the Army, Washington, D.C.

[21] Appl. No.: 410,159

[22] Filed: Aug. 20, 1982

[51] Int. Cl.[3] ..... A42B 3/02

[52] U.S. Cl. ..... 2/416; 2/6

[58] Field of Search ..... 2/416, 6

[56] References Cited

U.S. PATENT DOCUMENTS 3,015,103 1/1962 Zbikowski ..... 2/416
3,197,785 8/1965 Simpson et al. ..... 2/416
3,400,406 9/1968 Aileo ..... 2/6
3,456,263 7/1969 Aileo ..... 2/2
3,593,341 7/1971 Aileo ..... 2/209

*Primary Examiner*—Werner H. Schroeder
*Assistant Examiner*—Judith L. Kravitz
*Attorney, Agent, or Firm*—Robert P. Gibson; Anthony T. Lane; Lawrence E. Labadini

[57] ABSTRACT

A helmet suitable for use by combat vehicle crewmen comprises a rigid shell, formed of a ballistic resistant material, having earcup receiving extensions affixed thereto. Earcups are mounted in the shell extensions and are capable of movement in two directions relative thereto. The helmet also has an internal suspension system which affords two additional size adjustments.

15 Claims, 5 Drawing Figures

PROTECTIVE HELMET

The invention described herein may be manufactured, used and licensed by or for the Government for governmental purposes without the payment to us of any royalty thereon.

BACKGROUND OF THE INVENTION (1) Field of the Invention

The present invention relates to protective headgear and particularly to a helmet suitable for use by crew members of combat vehicles such as tanks. More specifically, this invention is directed to providing both ballistic and bump protection for combat vehicle crewmen while simultaneously limiting the sound from the environment which reaches the crewmen's ear to a level which is safe and permits communication. Accordingly, the general objects of the present invention are to provide novel and improved articles and methods of such character.

(2) Description of the Prior Art

The provision of a helmet which will comfortably fit combat vehicle crewman while providing the requisite protection and acoustic attenuation has presented a problem of long standing in the art. Such a helmet should afford the wearer with a measure of ballistic protection, protection from injury resulting from contact with surfaces within the vehicle and it should limit the noise from within the vehicle which reaches the wearers ear to a level which will not interfere with communication or damage hearing. All of the foregoing must be accomplished in headgear which is not unduly heavy, which may be adjusted to various size heads, which will not interfere with the required activities of the wearer and which may be worn with relative comfort for long periods of time. There has not previously been a helmet which would meet all of these requirements.

SUMMARY OF THE INVENTION

The present invention overcomes the above-briefly discussed and other deficiencies and disadvantages of the prior art by providing an improved combat vehicle crewman's helmet. A helmet in accordance with the present invention comprises a shell formed from a ballistic resistant material. This shell is shaped to receive an earcup housing, the housing being rigidly attached to the shell. Earcups are received in the housings. The earcups are anatomically designed to fit snuggly around the ears of the wearer and are capable of limited movement in two directions within the housing. A helmet in accordance with the present invention further comprises a unique suspension system which provides two additional degrees of adjustment of helmet to the head of the user.

In accordance with a preferred embodiment, the earcups are provided with integral ratchet devices which cooperate with the earcup housings and permit pivotal motion of the earcups, about a point on the housing disposed oppositely with respect to the ratchet device, toward or away from the wearer's head. The second degree of adjustment of the earcups is achieved by permitting rotation thereof within the housings.

The earcups of a helmet in accordance with the present invention receive an insert which will typically be comprised of a sound absorbing material such as a foam.

This insert will be provided with a pocket which receives an earphone.

A particularly unique feature of the present invention, resulting from the degrees of adjustment permitted by the suspension system and the cooperation between the earcup and its housing, resides in the fact that a positive pressure seal may be established between the earcup and the head of each individual user without reliance upon a chin strap. The foregoing results from the fact that the earcup is biased against the users head from a semi-rigid helmet shell which is itself adjustable relative to the users head.

The suspension system for a helmet in accordance with a preferred embodiment of the invention is adjustable at the front and rear and at the top of the helmet. The suspension system does not completely encircle the interior of the helmet and thus does not interfere with the establishment and maintenance of a positive pressure seal by the earcups against the head of the wearer. Accordingly, the helmet will be retained on the wearers head by means of a cradle-type suspension, which does not employ the side strap members typically found in the prior art, and by the pressure exerted by the earcups.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 1:
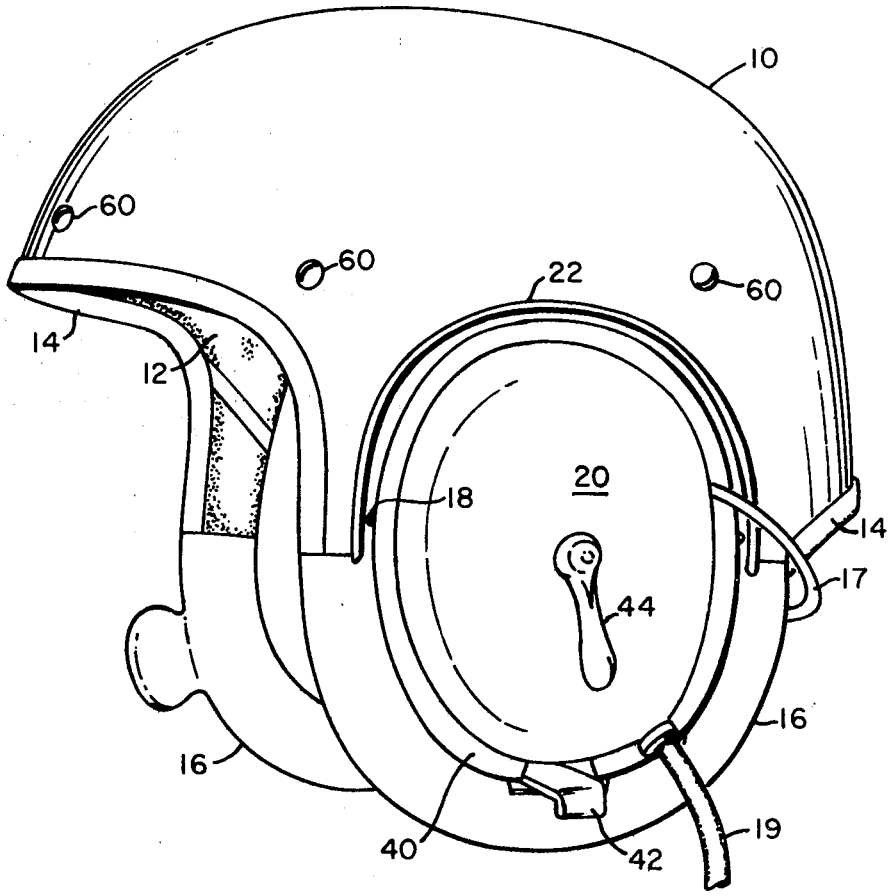
FIG. 1 is a perspective view of a helmet in accordance with the preferred embodiment of the invention.

With reference to the drawing, a helmet in accordance with the present invention commprises a semi-rigid shell 10 which is compression molded from a material characterized by light weight and exceptional resistance to penetration by objects impacting thereon. Shell 10 will preferably be a resin impregnated, woven fabric laminate, with the fabric constructed of "KEVLAR" yarns. The manufacture of shells of this type is described in U.S. Army Limited Production, Purchase Description for Helmet, Ground Troops, Parachutists, LP/PDes. 12–78 A, July 19, 1979. As may be seen from FIG. 4, the shell 10 is provided with a foam liner 12 which is adhesively secured thereto. Shell 10 is additionally provided, about a portion of its periphery, with a resilient edging 14 which is affixed to shell 10 by means of an adhesive.

A pair of earcup housing members 16, 16' are affixed to shell 10, preferrably by means of screws 18 or any other suitable attachment means which permits removal and replacement of the earcup housings. The housings 16, in one embodiment of the invention, are injection molded from polycarbonate resin. The earcup housings are affixed to shell 10 and, in part, are received in inverted U-shaped openings in opposite sides of the lower periphery of shell 10. The earcup housings define, as best seen from FIG. 4, generally oval-shaped openings which receive earcup subassemblies 20. The earcup housings 16 are provided, along the upper portion thereof, with an outwardly extending flange 22 which functions as a rain cap. Additionally, at the lower sides of the oval openings, the earcup housings 16 are provided with a slot or cut-out 24 for the purposes to be described below.

Figure 3:
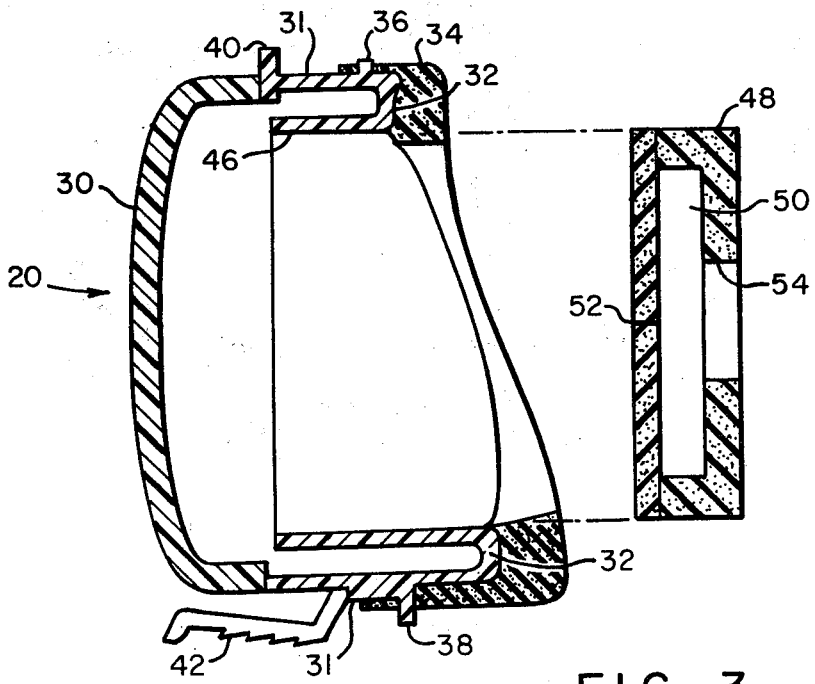
FIG. 3 is a cross-sectional side elevation view of an earcup subassembly of the helmet of FIG. 1.

As noted above, earcup subassemblies 20 are received in the earcup housings 16. Referring to FIG. 3, which depicts an earcup subassembly 20 in cross-section, the earcup subassemblies comprise a compression molded outer shell 30 which is preferably formed from the same material employed to form the helmet shell 10. The earcup subassemblies further comprise an inner shell portion 31 formed of a solid polymeric material such as ABS or polycarbonate. Inner shells 31 are rigidly attached to outer shells 30 by an adhesive or by fusion bonding. The earcup inner shells, along the peripheral portions 32 thereof which will face the head of the wearer, are anatomically designed to fit snuggly around the ear of the wearer to provide a good ear seal and good sound attenuation properties. The shape of portion 32 of the earcup shells has been determined by averaging the contour of the heads of a sampling of potential users. To further insure the establishment of a positive pressure seal, the portions 32 of shells 30 are provided with a foam rubber covering 34. Covering 34, which is removable, is held in place by engagement with stops 36 and 38 respectively molded in the upper and lower sides of inner shell 31.

Continuing to discuss the earcup subassemblies 20, a flange 40, spaced outwardly with respect to stops 36 and 38, extends about the inner shell 31, flange 40 being interrupted only in the area of the earcups which will be in registration with the cut-outs 24 in the earcup holders 16. The earcup subassemblies are installed in the helmet, specifically in the earcup holders 16, by inserting the earcups such that the housings 16 are partially positioned between the flange 40 and stop 36, this positioning placing the stops 36 and 38 to the interior of the housing. The earcup subassemblies are further provided with adjustment devices in the form of ratchets 42. The ratchets 42 are preferably comprised of a resilient plastic or metallic material having an appropriate degree of flexibility and are affixed to the shell portion 31 by any suitable means such as, for example, mechanical fasteners, chemical or fusion bonds. Upon insertion of the earcups in the housings, the ratchets 42 will extend through the cut-outs 24 and will cooperate with the wall of the housing in the vicinity of the associated cut-out as may be clearly seen from FIGS. 1 and 2. By manipulation of ratchet 42, the earcup subassembly may be pivoted about an axis defined by the line of contact between the upper portion of housing 16 and the region of inner shell 31 between flange 40 and stop 36. Thus, the spacing between the lower region of peripheral edge portion 32 and the wearer's head may be selectively adjusted by means of ratchet 42 and the compressive force exerted on foam covering 34 is accordingly variable to establish a positive seal about the users ears and to aid in retention of the entire helmet on the users head.

In addition to the pivotal motion of the earcup subassemblies relative to the remainder of the helmet, a limited degree of rotational motion, ten degrees for example, of the earcup subassemblies is permitted. This is accomplished by fabricating the inner shells 31 such that there is a slight clearance between the earcups, in the region between flange 40 and stop 36, and the housing 16. Additionally, as may be seen from FIG. 1, the width of the ratchet 42 is less than that of the cut-out 24. This limited degree of rotation constitutes a second degree of adjustment and assures a comfortable tight fit between the earcups and the wearer's head. It should be noted that this construction permits individual adjustment for each earcup.

Figure 2:
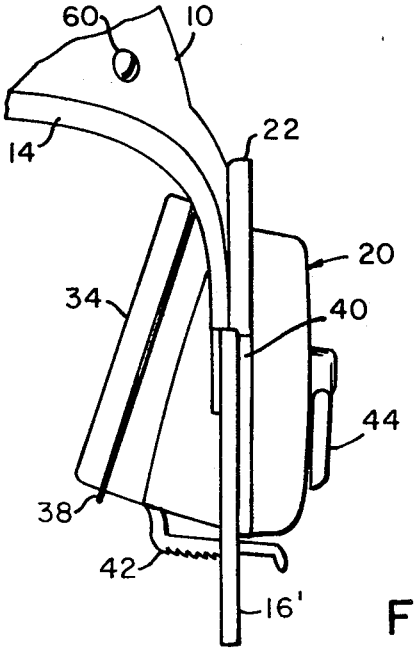
FIG. 2 is a partial front elevation view of the helmet of FIG. 1.

As may be seen from FIGS. 1 and 2, the shell 30 of at least one of the earcup subassemblies 20 for each helmet may be provided with an aperture through which the electrical conductors 19 for an earphone will extend to send and receive communication signals. Additionally, the earcup or earcups may be provided, extending from the exterior thereof, with a switch actuator 44 whereby an internally positioned earphone may be selectively turned on or off. The switch actuators 44 will, of course, have output shafts which extend through shell 30 and are connected to an electrical switch positioned within the earcup subassembly. Communications wire 17, which also extends through the earcup, delivers electrical signals from one earphone to the other earphone.

Referring again to FIG. 3, the inner shell 31 of the earcup subassemblies is preferably of double-wall construction as shown to increase rigidity and provide acoustic baffling. The inner wall 46 of the double wall portion of the earcup subassembly inner shell 31 defines a cylindrically shaped opening which receives an insert 48. The insert 48 will typically be formed from two pieces of resilient material, foam rubber for example, which define therebetween an earphone receiving opening or pocket 50. The foam member which faces the exterior of the helmet is provided with a slit 52 through which the earphone may be inserted into pocket 50. The foam member which faces the wearer's head is provided with a sound transmission opening 54 which will be in registration with the diaphragm of the earphone. The insert 48 is frictionally captured in the opening defined by wall 46.

Figure 4:
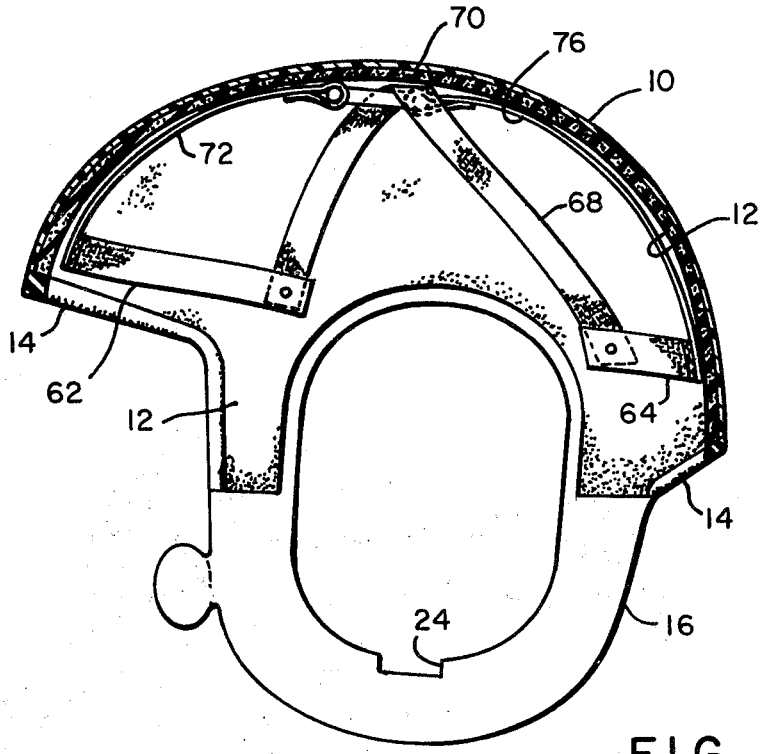
FIG. 4 is a cross-sectional side elevation view of the helmet of FIG. 1 with the earcup removed.
Figure 5:
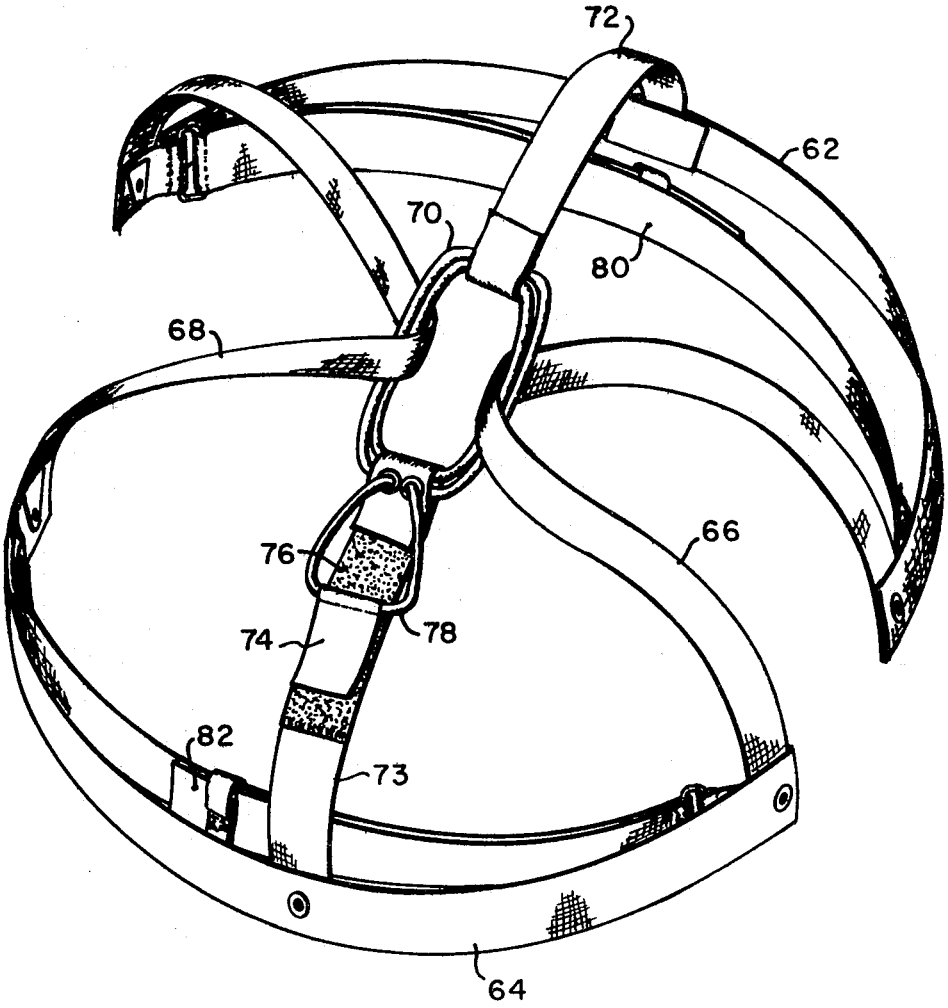
FIG. 5 is a perspective view of the suspension system of the helmet of FIG. 1.

The suspension system for a helmet in accordance with the present invention may be seen from joint consideration of FIGS. 4 and 5. It is first to be noted that the suspension system does not completely encircle the interior of the helmet and thus does not interfere with the earcup subassemblies 20. The suspension system includes an adjustable sweatband which comprises nylon webbing which is fastened to shell 10 by means of screws 60 (see FIG. 1). The sweatband webbing comprises arcuate front and rear straps which are respectively indicated at 62 and 64. The ends of straps 62 and 64 are interconnected by a pair of further nylon straps 66 and 68. Straps 66 and 68 are permenently attached, at their opposite ends, to adjacent opposite ends of straps 62 and 64 and pass through a loop 70 formed by a cord 78. A further length of nylon webbing 72 is attached at one end to strap 62 at the mid-point thereof. Strap 72 is, at its other end, permanently closed on itself to define a loop through which the loop 70 of cord 78 passes. An additional nylon webbing strap 73 is attached at its first end to strap 64 intermediate the ends of strap 64. Strap 73, at its opposite end, is formed into a permanently closed loop. Eyelets are provided in strap 73 in the region of this loop and cord 78 passes through these eyelets as shown. A"Velcro" pile 76 is attached to strap 73 by any suitable technique. A further short strap 74, which comprises a "Velcro" hook material, is permanently attached to cord 78. The cooperation between strap 74 and the "Velcro" pile 76 on strap 73 permits a height adjustment of the helmets suspension system by varying the size of loop 70. Size adjustment of the helmet may be achieved by varying the length of sweatband straps 80 and 82 which bridge the front and rear straps 62 and 64 respectively. Sweatband strap length adjustment may expeditiously be achieved by employing a "Velcro" fastener system on the same side of straps 80 and 82 with the pile and hooks being located adjacent to opposite ends of the straps. The straps 80 and 82 will pass through rings captured in nylon web loops which are permanently secured to the front and rear straps and the interconnecting straps.

As should be obvious from the preceeding description, the helmet suspension system permits two degrees of adjustment, i.e., size adjustment and height adjustment. The design and cooperation of the earcup subassemblies with the earcup housings permits two additional degrees of adjustment, i.e., a pivotal in-out movement and rotational movement to insure a comfortable fit and tight seal about the wearer's ears. All of the foregoing is achieved in a helmet of exceptional strength combined with light weight. The helmet system provides ballistic/bump protection over the total area emcompassed by the helmet by virtue of the fact that the outer shell of the earcup subassemblies and the main outer shell of the helmet are formed from the same high strength ballistic resistant plastic material. The essentially planar shape of the outer surface of the earcup subassemblies results in a helmet of relatively compact configuration.

A particularly novel feature of the present invention, as briefly discussed above, resides in the fact that retention of the helmet on the wearer's head, and a positive seal about the wearer's ears, is not dependent upon the fastening of a chin strap. Prior art helmets, which relied upon a chin strap, were characterized by application of non-uniform pressure to the earcups. Accordingly, when the wearer was talking or chewing, the pressure to the earcup was variable and constantly changing. In the present invention the earcups are biased against the wearer's head from a semi-rigid helmet shell and the ratchet adjustment of the earcups retains the acoustical seal with or without the chin strap being fastened.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A protective helmet comprising:

shell means, said shell means having a pair of oppositely disposed earcup receiving openings;

an earcup positioned in each of said shell means openings, said earcups being sized relative to said openings to permit a limited degree of relative rotation therebetween, said earcups further being individually movable in said shell means in a first direction whereby the helmet interior spacing between at least portions of said earcups may be varied;

ratchet means affixed to each of said earcups for stepwise adjusting the position of said earcups in said first direction, said ratchet means each cooperating with an edge portion of an earcup receiving opening; and adjustable suspension means mounted in said shell means.

2. The helmet of claim 1 wherein said shell means comprises:

an upper shell; and a pair of earcup holders affixed to and extending downwardly from said upper shell, said earcup holders defining said earcup receiving openings.

3. The helmet of claim 1 wherein said earcups each comprise:

an outer cup portion;

an inner cup portion, said inner cup portion extending from said outer cup portion and defining an anatomically shaped peripheral inner surface; and flange means, said flange means defining a channel which in part extends about the outer surface of the earcup, said channel cooperating with the shell about the periphery of an earcup receiving opening to capture said earcup in said opening.

4. The helmet of claim 2 wherein said earcups each comprise:

an outer cup portion;

an inner cup portion, said inner cup portion extending from said outer cup portion and defining an anatomically shaped peripheral inner surface; and flange means, said flange means defining a channel which in part extends about the outer side surface of the earcup, said channel cooperating with the earcup holder about the periphery of the earcup receiving opening defined thereby to capture said earcup in said opening.

5. The helmet of claim 4 wherein said upper shell and said earcup outer portion are formed from a fiber reinforced plastic material.

6. The helmet of claim 4 wherein said ratchet means are affixed to said earcup inner portions and wherein said earcup receiving openings are provided with a ratchet means receiving cut-out at the lower edges thereof, said cut-outs being of greater width than said ratchet means to permit the rotational movement of said earcups.

7. The helmet of claim 1 wherein said suspension means comprises:

discontinuous sweatband means, said sweatband means being attached to the interior of said shell means and including a front strap and a rear strap;

height adjustment strap means extending between points on said sweatband means front and rear straps intermediate the ends thereof, said adjustment strap means being of variable length; and a pair of interconnecting straps, said interconnecting straps extending between adjacent ends of said sweatband means front and rear straps, said interconnecting straps being supported intermediate their ends from said height adjustment strap means.

8. The helmet of claim 7 wherein said sweatband means further comprises an adjustable sweatband extending between the ends of at least one of said sweatband means straps.

9. The helmet of claim 7 wherein said sweatband means is discontinuous in the vicinity of said earcups.

10. The helmet of claim 4 wherein said suspension means comprises:

sweatband means, said sweatband means being attached to the inside of said upper shell and being discontinuous in the region of said earcups, said sweatband means including a front strap and a rear strap;

height adjustment strap means extending between points on said sweatband means front and rear straps intermediate the ends thereof, said adjustment strap means being of variable length; and a pair of interconnecting straps, said interconnecting straps extending between adjacent ends of said sweatband means front and rear straps, said interconnecting straps being supported intermediate their ends from said height adjustment strap means.

11. The helmet of claim 10 wherein said height adjustment strap means comprises:

first and second web members, said web members being affixed to and extending from respective of said sweatband means straps;

a loop comprised of a cord extending between the free ends of said web members, said interconnecting straps passing through said loop; and means for adjusting the size of said loop.

12. The helment of claim 11 wherein said sweatband means is adjustable.

13. The helmet of claim 12 wherein said earcups each further comprise:

a resilient insert, said insert being frictionally captured in said inner cup portion and having an earphone receiving pocket formed therein.

14. The helmet of claim 13 wherein said upper shell and said earcup outer portion are formed from a fiber reinforced plastic material.

15. The helmet of claim 14 wherein said ratchet means are affixed to said earcup inner portions and wherein said earcup receiving openings are provided with a ratchet means receiving cut-out at the lower edges thereof, said cut-outs being of greater width than said ratchet means to permit the rotational movement of said earcups.

* * * * *